US011167166B2

(12) United States Patent
Goetz

(10) Patent No.: US 11,167,166 B2
(45) Date of Patent: Nov. 9, 2021

(54) HEAVY DUTY AND REPAIRABLE MEDICINE BALL

(71) Applicant: David Patrick Goetz, San Antonio, TX (US)

(72) Inventor: David Patrick Goetz, San Antonio, TX (US)

(73) Assignee: David Patrick Goetz, San Antonio, TX (US)

( * ) Notice: Subject to any disclaimer, the term of this patent is extended or adjusted under 35 U.S.C. 154(b) by 37 days.

(21) Appl. No.: 16/729,058

(22) Filed: Dec. 27, 2019

(65) Prior Publication Data

US 2021/0197009 A1 Jul. 1, 2021

(51) Int. Cl.
*A63B 21/06* (2006.01)
*A63B 65/06* (2006.01)

(52) U.S. Cl.
CPC ..... *A63B 21/0605* (2013.01); *A63B 21/0607* (2013.01); *A63B 65/06* (2013.01); *A63B 2209/00* (2013.01)

(58) Field of Classification Search
CPC . A63B 65/06; A63B 21/0605; A63B 21/0607; A63B 2209/00; A63B 2102/00; A63B 2102/14; A63B 2102/18; A63B 2102/30
See application file for complete search history.

(56) References Cited

U.S. PATENT DOCUMENTS

2003/0211919 A1* 11/2003 Chen ..... A63B 41/08 482/93
2009/0170639 A1* 7/2009 Wong ..... A63B 67/002 473/415
2013/0005521 A1* 1/2013 White ..... B29C 65/02 473/604
2013/0225322 A1* 8/2013 Fitchett ..... A63B 37/0003 473/368

* cited by examiner

*Primary Examiner* — Nyca T Nguyen
*Assistant Examiner* — Andrew M Kobylarz

(57) ABSTRACT

A heavy duty, repairable weighted ball used for exercising capable of being loaded to heavy weights and being used on uneven or rough surfaces. The shell of the ball being constructed by a plurality of pieces of material in two layers: an inner encompassing layer capable of holding the weighted material and an outer layer holding the inner layer together. The pieces are joined together such that on being damaged they can be replaced individually. The pieces can be composed of a variety of materials, including repurposed or recycled material.

16 Claims, 3 Drawing Sheets

HEAVY DUTY AND REPAIRABLE MEDICINE BALL

CROSS-REFERENCE TO RELATED APPLICATIONS

This application claims priority from U.S. Provisional Patent Application No. 62/786,503 filed on Dec. 30, 2018 and entitled Heavy Duty and Repairable Medicine Ball, which application is hereby incorporated by reference.

TECHNICAL FIELD

The technical field relates generally to the field of fitness equipment and, more specifically relates to the field of medicine balls.

BACKGROUND

Medicine balls are a widely used piece of equipment used for exercise and physical therapy. Common exercises include throwing the ball between partners or against a wall or doing any number of regular exercise movements while holding the ball to provide extra weight and resistance.

While the above uses are not very taxing to the structure of the ball a common exercise using one of these balls is to lift it from the ground, raise it above your head, and then forcefully slam the ball to the ground. This is a full body exercise: the legs to squat to lift the ball, the hands to grip, the arms and shoulders to lift above your head, and the core abdomen muscles to slam it down. It is both an aerobic and strength exercise, and because of the range of movements and slamming action, it is quite dynamic and satisfying and has become very popular recently.

Because these medicine balls are usually heavy, typically ranging from 12 to 100 pounds, a considerable amount of force is applied to the ball with each exercise. This amount of force often proves to be too much for most medicine balls available today. Often these balls are made of leather pieces sewn together or a thick walled rubber or plastic bladder filled with sand or some similar material. See U.S. Pat. No. 5,286,020 (1994), U.S. Pat. No. 4,917,381 (1990). The thread holding the leather often begins to tear, and the smallest hole in a bladder will start leaking sand, which makes a mess whenever the ball is used and will eventually ruin it entirely. Once the ball is damaged, it is very difficult to repair if it can be repaired at all. Some manufacturers of medicine balls on the market discourage slamming the balls by having that action void the warranty. Using one of these balls outdoors or on pavement especially must be avoided as it will quickly destroy the equipment.

The medicine ball of this invention can also be made largely of repurposed materials. Many consumers do not want to buy leather products made from animals or want to buy new plastic balls that, because they are bound to break, will end up being more trash in the environment. The rubber pieces for this new design can be made out of rubber cut from the walls of used automobile tires. In many cases the material is free, readily available almost anywhere, is extremely durable, does not harm animals, and actually prevents much of the tire from just being thrown out. The filling for the ball can also be sourced from repurposed materials. For example, discarded rebar from construction projects can be cut up for the filling. This rebar is also widely available at local steel scrap yards.

SUMMARY

Embodiments described herein for a medicine ball is substantially more durable than other balls on the market, allowing it to be loaded in heavier weights and be used in a wider range of environments. These embodiments can be made from repurposed materials and if one does become damaged it is easy to repair.

Because of the greater durability of the ball people will be able to use the ball to do more slamming exercises. They will also be able to work out outside on pavement with the ball if they desire. Because the ball can be loaded with weights up to 100 lbs and still be able to be slammed down to the ground, there very seldom will be a time when stronger weightlifters would not be challenged by the exercise. In addition, if the ball does become damaged it can be repaired without specialized equipment or training: simply by cutting out the broken section, and bolting a new one in its place.

BRIEF DESCRIPTION OF THE DRAWINGS

FIGS. 2*a*, 2*b*, and 2*c* are made of a strong material—in some embodiments rubber with nylon webbing cut from tire walls can be used. The material used for the pieces of 2*a* need not be the same material as for 2*b* and 2*c* but in this embodiment they are. The pieces can be sized up or down to make larger or smaller balls. In the embodiment described herein, the inner layer is made entirely of 12 pentagonal pieces (FIG. 2*a*) and the outer strap pieces used to join the inner layer together are made according to FIGS. 2*b* and 2*c*. There are holes cut into the material (FIGS. 2*e*, 2*f*, 2*g*) that will be joined together using fasteners. FIG. 2*d* shows a strong webbing material, in some embodiments a nylon webbing, which is used to protect the joints of the inner layer pieces on the inside of the ball.

DETAILED DESCRIPTION

Figure 1:
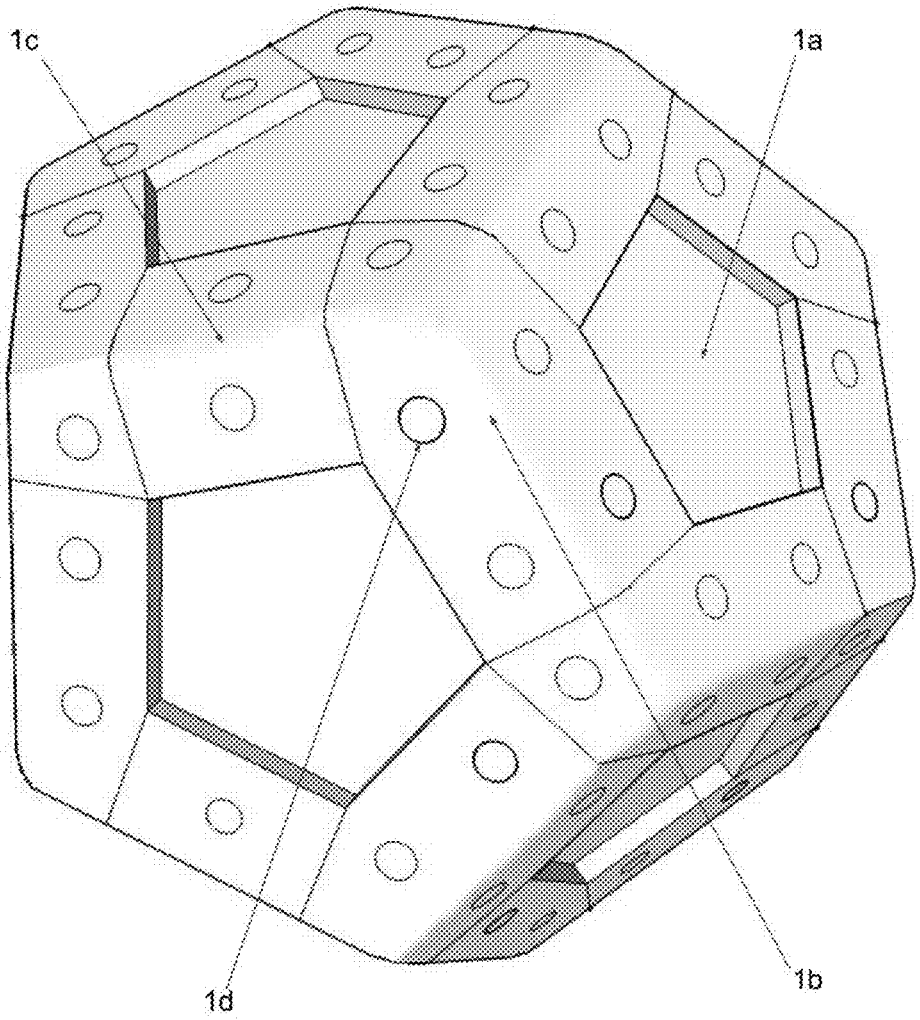
FIG. 1 shows a medicine ball according to one embodiment. In this embodiment, the pentagonal pieces of the encompassing inner layer (1*a*) are joined together to make a regular dodecahedron. The outer strap pieces (1*b* and 1*c*) hold the inner pieces together with fasteners. The holes (1*d*) are punched through both layers.
Figure 2:
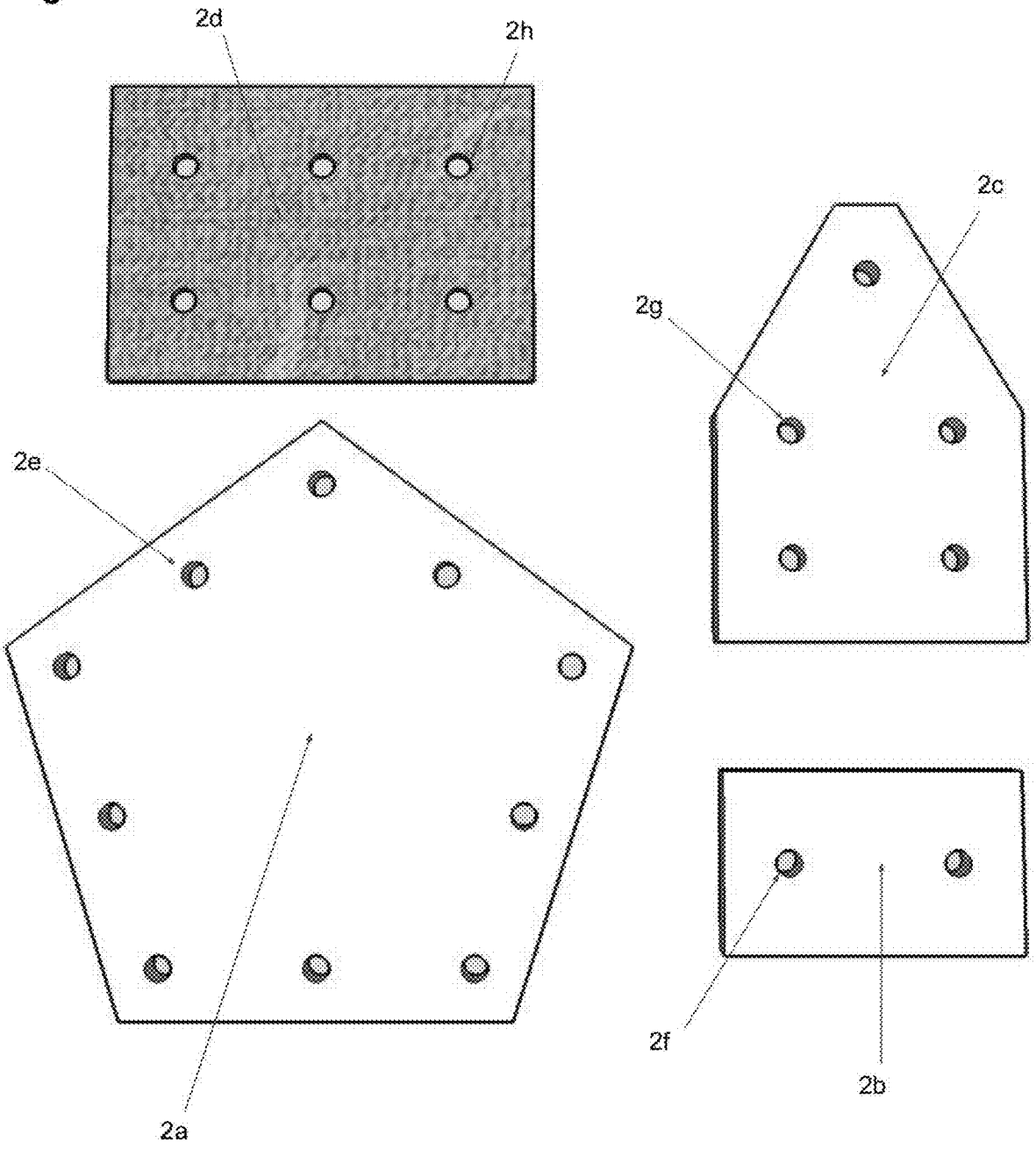
FIG. 2 shows the individual pieces used to build the medicine ball according to one embodiment.
Figure 3:
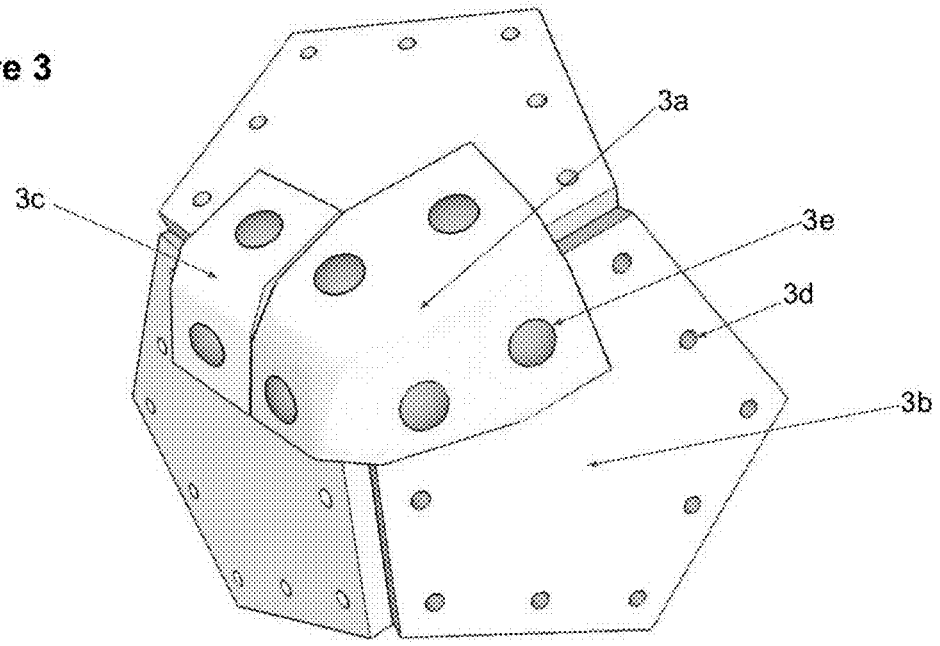
FIG. 3 shows how, according to one embodiment, three pieces forming the inner layer (FIG. 2*a*) would be joined using the strap pieces (FIGS. 2*b* and 2*c*). In one embodiment, the bolts are ¼" stainless steel carriage bolts, which ensure the fasteners won't rust and the rounded heads will protect a user's hands.
Figure 4:
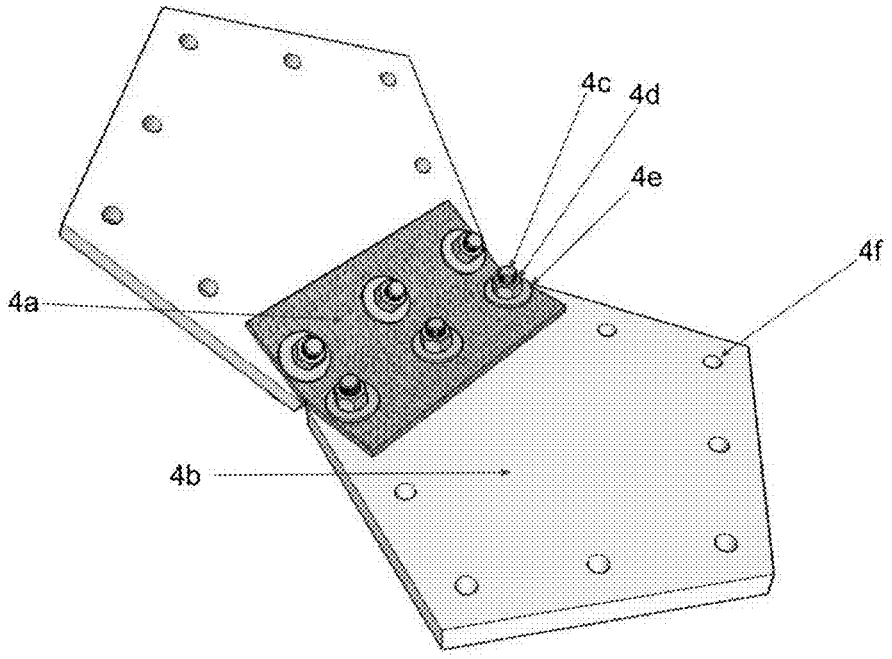
FIG. 4 shows how, according to one embodiment, the webbing (FIG. 2*d*) could be used when attaching to pieces of the inner layer (FIG. 2*a*). In this embodiment, the bolts (FIG. 4*c*) are held in place with stainless steel fender washers (FIG. 4*e*) and stainless steel, nylon insert lock nuts (FIG. 4*d*).

In accordance with the present invention there is shown in FIG. 1 a view of the medicine ball fully constructed showing the pieces of the inner layer (FIG. 2*a*) joined together using the strap pieces (FIG. 2*b*, 2*c*). In one embodiment described herein all the pieces are made of ⅜-½ inch rubber with internal nylon webbing cut from used car tires. Another embodiment could use new rubber, polyethylene, PVC or some other flexible, non-stretchable material to make the pieces of the shell. As shown in FIG. 2, holes are punched (in one design, ¼ in diameter holes) around the edges of each piece so that they can be joined together using fasteners as shown in FIG. 3. In one embodiment bolts or rivets can be used to join the pieces together. A strong nylon rope or steel cable could also be used. In the embodiment described herein, each fastener will pass through the strap in the outer layer, (FIG. 2*b* or 2*c*), then through the inner layer (FIG. 2*a*), then through the webbing (FIG. 2*d*), then a washer and a nut, as seen in FIG. 4. The webbing prevents the inside nut and washer from tearing through the inner enclosure. In one embodiment this webbing is made from 3 inch nylon tow strap although other materials could be used. The webbing also prevents any dust inside the ball from escaping.

The size of the ball can be increased or decreased by having larger or smaller pieces—as long as the ratio of their sizes is maintained. In one embodiment the filling of the ball is 1 to 3 inch cut up pieces of rebar, however steel ball bearings of similar material could also be used. It is mostly important that the filling be made of material large enough so that will not be able to leak out of the ball in case small openings appear through normal usage of the ball.

In the embodiment described herein, the ball is assembled having the outer strap pieces attached to the inner enclosing layer, as shown in FIG. 3, in a pattern as seen in FIG. 1. In one embodiment, the assembly requires 12 pieces of FIG. 2*a*, 20 of FIG. 2*c*, and 10 of FIG. 2*b* to be fully built. In one embodiment, the ball is assembled until there is a single piece of FIG. 2*b* remaining to be placed in. Then the filling is added in. After the filling is added, the final three bolts are added with the rounded top of the bolt inside the inner enclosure and the threaded rod coming out through the strap pieces. The flexible strap (FIG. 2*b*) is then attached to these bolts and the bolts are cut down to slightly above the strap piece. A washer and nut are attached and welded to the bolt to prevent the nut from coming loose.

The two layer shell system described in this embodiment of the ball is very effective. The outer layer, FIGS. 2*b* and 2*c*, provides a grip to the user in picking up the ball—as opposed to many current medicine balls which are difficult to handle when heavy. This outer layer is also what takes the bulk of the wear when slamming the ball on the ground. The fasteners, going through both the outer strap layer and the inner enclosing layer, are very stable and do not tear into the material. Because of the number of fasteners involved, no one piece is ever put under too much pressure. In the event that one of the strap or inner enclosure pieces does tear it can replaced fairly easily and without expensive equipment. The fasteners holding it in place would need to be cut and only the broken pieces need to be replaced.

I claim:

1. A device for exercising, comprising:

(a) An encompassing inner layer comprising a plurality of non-stretchable pieces of material joined together to form a dodecahedron; and (b) said inner layer being held together using a plurality of flexible strap pieces of material; and (c) said flexible strap pieces are attached to said inner layer by steel bolts such that said inner layer is held together (d) said encompassing inner layer providing an enclosure where a quantity of weighted material is securely stored whereby a human can exercise using the device.

2. The device of claim 1, wherein the non-stretchable pieces of material comprise rubber.

3. The device of claim 1, wherein the non-stretchable pieces of material comprise rigid plastic.

4. The device of claim 1, wherein the non-stretchable pieces of material comprise metal.

5. The device of claim 1, wherein the non-stretchable pieces of material comprise repurposed or recycled material such as nylon reinforced rubber cut from automobile tires.

6. The device of claim 1, wherein the non-stretchable pieces of material comprise a sufficiently durable material that the device can be slammed on a rough surface, repeatedly without being damaged.

7. The device of claim 1, wherein the non-stretchable pieces of material are joined together by said steel bolts such that if one piece is damaged it can be replaced individually with minimal impact to the rest of the device.

8. The device of claim 1, wherein the flexible strap pieces of material comprise rubber.

9. The device of claim 1, wherein the flexible strap pieces of material comprise flexible plastic.

10. The device of claim 1, wherein the flexible strap pieces of material comprise repurposed or recycled material including nylon reinforced rubber cut from automobile tires.

11. The device of claim 1, wherein the flexible strap pieces of material comprise a sufficiently durable material that the device can be slammed on a rough surface, repeatedly without being damaged.

12. The device of claim 1, wherein the flexible strap pieces of material are joined to the encompassing inner layer by said steel bolts that if one piece is damaged it can be replaced individually or in small groups with minimal impact to the rest of the device.

13. The device of claim 1, wherein the flexible strap pieces of material help the human grip the device while in use.

14. The device of claim 1, wherein the weighted material comprise pieces of steel.

15. The device of claim 1, wherein the weighted material comprises repurposed or recycled material including cut up scrap steel rebar.

16. The device of claim 1, wherein the weighted material has sufficient space in the enclosure of said inner layer to move around freely providing a more complete exercise as the human grips the device.

* * * * *